US011828127B2

(12) United States Patent
Bartlett

(10) Patent No.: US 11,828,127 B2
(45) Date of Patent: Nov. 28, 2023

(54) TUBING HANGER WITH SHIFTABLE ANNULUS SEAL

(71) Applicant: Dril-Quip, Inc., Houston, TX (US)

(72) Inventor: Chris D. Bartlett, Spring, TX (US)

(73) Assignee: Dril-Quip, Inc., Houston, TX (US)

( * ) Notice: Subject to any disclaimer, the term of this patent is extended or adjusted under 35 U.S.C. 154(b) by 295 days.

(21) Appl. No.: 17/414,809

(22) PCT Filed: Dec. 17, 2019

(86) PCT No.: PCT/US2019/066723

§ 371 (c)(1),
(2) Date: Jun. 16, 2021

(87) PCT Pub. No.: WO2020/139613

PCT Pub. Date: Jul. 2, 2020

(65) Prior Publication Data

US 2022/0018203 A1 Jan. 20, 2022

Related U.S. Application Data

(60) Provisional application No. 62/785,421, filed on Dec. 27, 2018.

(51) Int. Cl.
*E21B 33/047* (2006.01)
*E21B 34/02* (2006.01)
*E21B 33/043* (2006.01)

(52) U.S. Cl.
CPC ..... *E21B 33/047* (2013.01); *E21B 34/02* (2013.01); *E21B 33/043* (2013.01)

(58) Field of Classification Search
CPC ..... E21B 33/04; E21B 33/043; E21B 34/02; E21B 33/035; E21B 33/038; E21B 33/047; E21B 34/04
See application file for complete search history.

(56) References Cited

U.S. PATENT DOCUMENTS 5,143,158 A * 9/1992 Watkins ..... E21B 34/04 166/344
5,188,181 A * 2/1993 Brammer ..... E21B 33/143 166/344

(Continued)

FOREIGN PATENT DOCUMENTS

WO WO-0173256 A1 * 10/2001 ..... E21B 33/0355
WO WO-2012060909 A1 * 5/2012 ..... E21B 33/03

OTHER PUBLICATIONS

International Preliminary Report on Patentability issued in related PCT Application No. PCT/US2019/066723 dated Jul. 8, 2021, 8 pages.

(Continued)

*Primary Examiner* — Daniel P Stephenson
(74) *Attorney, Agent, or Firm* — Baker Botts L.L.P.

(57) ABSTRACT

A tubing: hanger assembly with a shiftable annulus seal is provided. The shiftable annulus seal allows for selectively sealing the tubing hanger within a easing hanger, a wellhead, or a tubing head. The tubing hanger assembly also includes a secondary annulus flow path formed through the body of the tubing hanger. The shiftable annulus seal selectively opens/closes a relatively large flow path to the tubing string annulus for circulation of fluid through the tubing string and setting a-packer. The secondary annulus flow path facilitates monitoring and bleeding of pressure front the annulus after the shiftable annulus seal is closed.

20 Claims, 3 Drawing Sheets

(56) References Cited

U.S. PATENT DOCUMENTS

| | | | | |
|---|---|---|---|---|
| 5,687,794 | A | 11/1997 | Watkins et al. | |
| 2010/0116488 | A1 | 5/2010 | Baskett et al. | |
| 2012/0160513 | A1 | 6/2012 | Bryson | |
| 2016/0251926 | A1 | 9/2016 | Murphy | |
| 2018/0100364 | A1 | 4/2018 | Nguyen | |
| 2020/0370387 | A1* | 11/2020 | Wang | E21B 33/043 |
| 2022/0018203 | A1* | 1/2022 | Bartlett | E21B 34/02 |

OTHER PUBLICATIONS

International Search Report and Written Opinion issued in related PCT Application No. PCT/US2019/066723 dated May 18, 2020, 11 pages.

* cited by examiner

TUBING HANGER WITH SHIFTABLE ANNULUS SEAL

CROSS-REFERENCE TO RELATED APPLICATIONS

The present application is a U.S. National Stage Application of International Application No. PCT/US2019/066723 filed Dec. 17, 2019, which claims priority to U.S. Provisional Application Ser. No. 62/785,421 filed on Dec. 27, 2018 both of which are incorporated herein by reference in their entirety for all purposes.

TECHNICAL FIELD

The present disclosure relates generally to subsea completion systems and, more particularly, to a tubing hanger with a shiftable annulus seal to enable circulating, isolating, monitoring, and venting the annulus in a subsea completion system.

BACKGROUND

Conventional subsea completion systems include a wellhead housing mounted on the upper end of a subsurface casing string extending into a wellbore. During a drilling, procedure, a drilling riser and blowout preventer (BOP) are installed above a wellhead housing to provide pressure control as casing is installed, with each casing string having a casing hanger on its upper end for landing on a shoulder within the wellhead housing. A tubing string is then installed. A tubing hanger is included in the tubing string to land, lock, and seal into the wellhead housing (or a tubing head). The tubing hanger is connected to the upper end of the tubing string and, once installed, is supported above the casing hanger(s) to suspend the tubing string within the casing string(s).

In conventional tubing hangers, there is an annulus bore or flow path (with an isolation device) through the tubing hanger that facilitates circulation of fluids and setting a downhole packer once the tubing hanger is landed. This flow path is necessary because, traditionally, the tubing hanger seals are permanently engaged once the tubing hanger is landed. After setting the packer, the annulus flow path through the tubing hanger is then temporarily isolated via a wireline plug set in the flow path, or by closing, an isolation valve/device. The isolation valve/device could be in the tubing hanger itself, or it could be positioned in a tubing head that provides a flow path around the tubing hanger seals. Isolating the annulus flow path in this way allows the operator to retrieve the tubing hanger running tool and to retrieve the marine riser and BOP stack. This annulus barrier, along with two barriers for the production bore, temporarily prevent well fluids from escaping to the environment during the period between removal of the drilling well control device (i.e., the BOP) and installation of the production well control device (i.e., the subsea tree). Once the subsea tree is installed, it acts as the primary well control device. The temporary barriers can then be removed or opened.

The process of setting (or closing) these temporary barriers in the annulus flow path before retrieving the BOP can be time consuming (if a wireline plug is set) and/or expensive (due to the large size of a tubing hanger with built-in isolation device). It is now recognized that lower profile tubing hanger systems and more efficient installation methods are desired to simplify/reduce the cost of completion installation and servicing operations.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
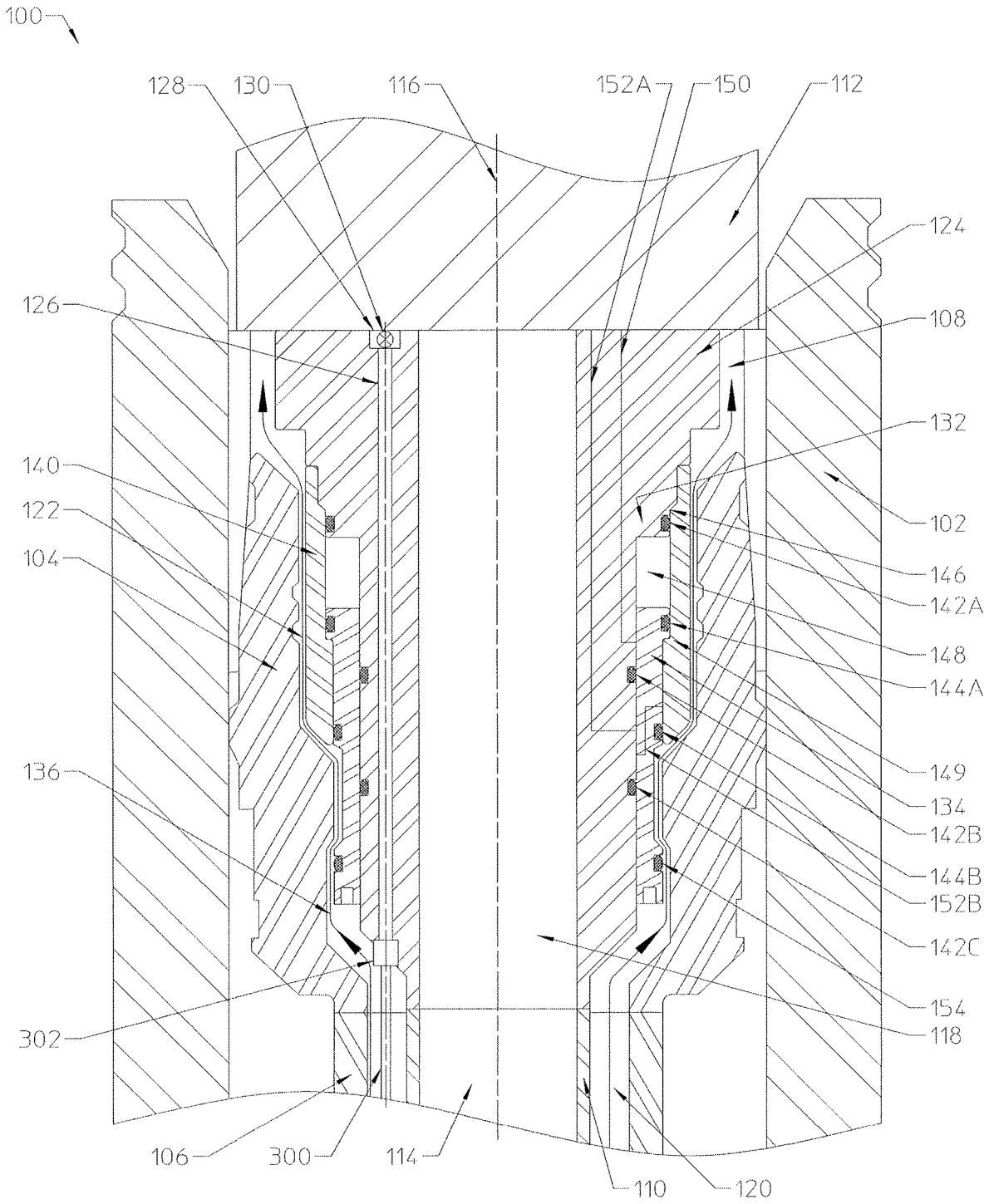
FIG. 1 is a partial cutaway view of a completion assembly including a tubing hanger with a shiftable annulus seal in an open configuration, in accordance with an embodiment of the present disclosure.

Illustrative embodiments of the present disclosure are described in detail herein, in the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

Certain embodiments according to the present disclosure may be directed to a tubing hanger assembly that includes; a shiftable annulus seal for sealing the tubing hanger within a casing hanger, a wellhead, or a tubing head; and a secondary annulus flow path formed through the body of the tubing hanger. The shiftable annulus seal selectively opens/closes a relatively large flow path to the tubing string annulus for circulation of fluid through the tubing string and setting a packer. The secondary annulus flow path facilitates monitoring and bleeding of pressure from the annulus after the shiftable annulus seal is closed. This provides an efficient process for installing, a subsea completion, without taking up a large amount of space in the tubing hanger/tubing head, and while still providing the desired annulus access during installation and later production operations.

In convention completion systems, the tubing hanger has an annulus port or flow path extending therethrough. The port helps facilitate circulation of fluid through the tubing string during installation, allowing fluid to circulate downhole through the tubing, string, around a production packer, and returning up through the annulus. During the installation process, an operator sets the production packer by isolating the bottom of the production tubing, thereby cutting off the circulation path. Later, the same port or flow path is used to monitor any pressure build up in the annulus (e.g., due to a thermal gradient). This annulus port or flow path, however, has to be closed off at one or more times during the installation and later workover operations. For example, after running in and sealing the tubing hanger within the wellhead/casing hanger, the annulus now path will be closed off so that the BOP/marine riser can be retrieved to the surface and replaced with a subsea tree or other connection interface. After the connection of the subsea tree, the annulus flow path can be reopened to enable pressure monitoring/bleeding of the annulus.

In some instances, the method of closing off the annulus flow path involves setting a wireline plug into the flow path. A riser and wireline trip is then needed to retrieve the plug once the subsea tree is installed. This can be a very expensive endeavor. Another option is to close off the annulus flow path through the tubing hanger using a valve that is either in the tubing hanger itself or a tubing head. That way, after the subsea tree is installed, a control system may simply reopen the valve to place the completion into a producing mode. In both instances of temporarily closing the annulus flow path through the tubing hanger, this flow path which was previously used for circulation and setting the packer is then used to monitor and vent pressure that may build up during production. The disclosed completion assembly, however, separates the functionality of these two modes (installation and production) by having two separate flow paths through the tubing hanger that accommodate and allow for the same functionality with less complexity.

Conventional tubing hangers are sealed to the easing hanger, wellhead, or tubing head by means of a stationary seal that, once set, cannot be disengaged and later re-engaged. This seal is set and tested when the tubing hanger lands in the wellhead. In the disclosed completion assembly, however, the annulus seal used to seal the tubing hanger against a casing string, wellhead, and/or tubing head selectively movable between a sealing location and a non sealing location. This provides a large flow area that allows for circulating fluids and applying pressure to set a downhole packer. For most wells, such a large circulation flow path is only needed during the initial installation process. Once the annulus is conditioned, desired fluids have been circulated into place, and the production packer is set, the annulus seal can be shifted into the "closed" or sealing position. The shiftable seal remains in this sealed position until either the well is abandoned or the completion is required to be pulled for a workover event. Once the tubing hanger is landed, locked, and the annulus seal is engaged, the second flow path through the tubing hanger is used for monitoring and venting pressure in the production annulus.

The disclosed systems and methods have a number of advantages over existing completions, as will be apparent from the following description. As an example, the shiftable annulus seal eliminates the need for any large annulus bore wireline plug, ball valve, or gate valve to be placed/actuated in the tubing hanger. These devices are typically large and difficult to package in concentric tubing hanger designs. In addition, the shiftable annulus seal may eliminate the need for a separate tubing head, which is often used to house the large annulus flow path when space in the tubing hanger is limited. Further, when the shiftable annulus seal is used in combination with a production isolation valve, all temporary well barriers can be incorporated either within or below the tubing hanger thereby simplifying the subsea tree and other completion hardware.

Turning now to the drawings, FIG. 1 is a partial cutaway view of a completion assembly 100, in accordance with an embodiment of the present disclosure. The completion assembly 100 may include, among other things, a wellhead housing 102, a casing hanger 104 supporting a casing string 106, a tubing hanger 108 supporting a production tubing string 110, and a tubing hanger running tool 112. During installation of the completion assembly 100, the casing hanger 104 may be landed in and sealed against the wellhead housing 102. Then, the tubing hanger running tool 112 lowers the tubing hanger 108 into the wellhead housing 102, where the tubing hanger 108 may be seated on, but not yet sealed against, the casing hanger 104.

The illustrated embodiments show the tubing hanger 108 with a shiftable annulus seal assembly 132 that selectively seals an annulus between the tubing hanger 108 and a casing hanger 104. It should be noted, however, that the same type of shiftable annulus seal assembly 132 can be used in tubing hangers 108 that seal directly against the wellhead 102 or a separate tubing head. The embodiments disclosed in this application are not limited to sealing against a casing hanger.

The tubing hanger 108 is attached at its lower end to the tubing string 110, which extends downward through the casing string 106 in the wellbore below the wellhead 102. The tubing string 110 is a production tubing string, meaning that it is used to produce hydrocarbons from a subterranean formation penetrated by the wellbore. During initial installation of the completion system 100, hydrocarbons are not yet being produced through the tubing string 110. The tubing string 110 has an internal (production) flow bore 114 extending therethrough along an axis 116. This production flow bore 114 of the tubing string 110 is coupled to a production flow bore 118 of the tubing hanger 108. An annulus 120 is formed between an outer diameter of the production tubing string 110 and an inner diameter of the surrounding casing string 106.

During the following description, all references to a radial or axial location (or movement) are taken to be with respect to the longitudinal axis 116. A radial direction with respect to this axis 116 means a direction that is perpendicular to the axis. The terms "radially external" or "radially outward" mean farther away from the axis in the radial direction, and "radially internal" or "radially inner" mean closer to the axis in the radial direction. An axial direction with respect to this axis 116 means a direction that is parallel to the axis.

The disclosed tubing hanger 108 includes two separate flow paths 122 and 126 through which fluid and/or pressure from the annulus 120 can pass through the tubing hanger 108. A first annulus flow path 122 is defined by an annular space between a main body 124 of the tubing hanger 108 and the casing hanger 104 (or alternatively, wellhead or tubing head) in which the tubing hanger 108 is landed. This first flow path 122 extends from the annulus 120 at a lower end to an annular space between the tubing hanger 108 and the wellhead housing 102 at an upper end. As shown in the illustrated embodiment, this first annulus flow path 122 may extend directly to the tubing hanger running tool 112. Although not illustrated, the running tool 112 may include a flow path formed therethrough that intersects or interfaces with this first annulus flow path 122 through the tubing hanger 108 to fluidly connect this flow path 122 to another circulation annulus flow path located above the illustrated completion system 100.

A second annulus flow path 126 through the tubing hanger 108 is defined by a bore extending vertically through the main body 124 of the tubing hanger 108. This annulus flow path 126 extends from the annulus 120 at a lower end to a standard hydraulic coupling 128 at its upper end. The hydraulic coupling 128 may be coupled directly to another flow path extending through the running tool 112. When the running tool 112 is removed and replaced by, for example, a subsea tree, the subsea tree may include a complementary port therethrough that stabs into the coupling 128.

The hydraulic coupling 128 may be equipped with a valve 130 as shown. This valve 130 may be a check valve with a double-sealing poppet, a bi-directional valve (e.g., gate valve), or any other desired type of valve to selectively block flow through the annulus flow path 126. This valve 130 may act as a temporary annulus barrier whenever the main well control devices (e.g., BOP during completion operations, or subsea tree during production operations) are removed.

In accordance with the present disclosure, the two annulus flow paths 122 and 126 through the tubing hanger 108 are used to perform different functions. The first flow path 122 is used primarily during the initial completion operations, while the second flow path 126 may be used throughout production operations. The desired annulus flow through the tubing hanger 108 for normal production operations (e.g., monitoring and/or bleeding annulus pressure) does not require the same flow cross-sectional area as the desired annulus flow through the tubing hanger 108 for completion operations (e.g., circulating fluid and setting the production packer). As such, the second annulus flow path 126 has a relatively small diameter such as, for example, a ¼", ⅜", ½", or ¾" diameter, while the annular flow path 122 provides a much larger cross-sectional area for annulus fluid communication.

Figure 2:
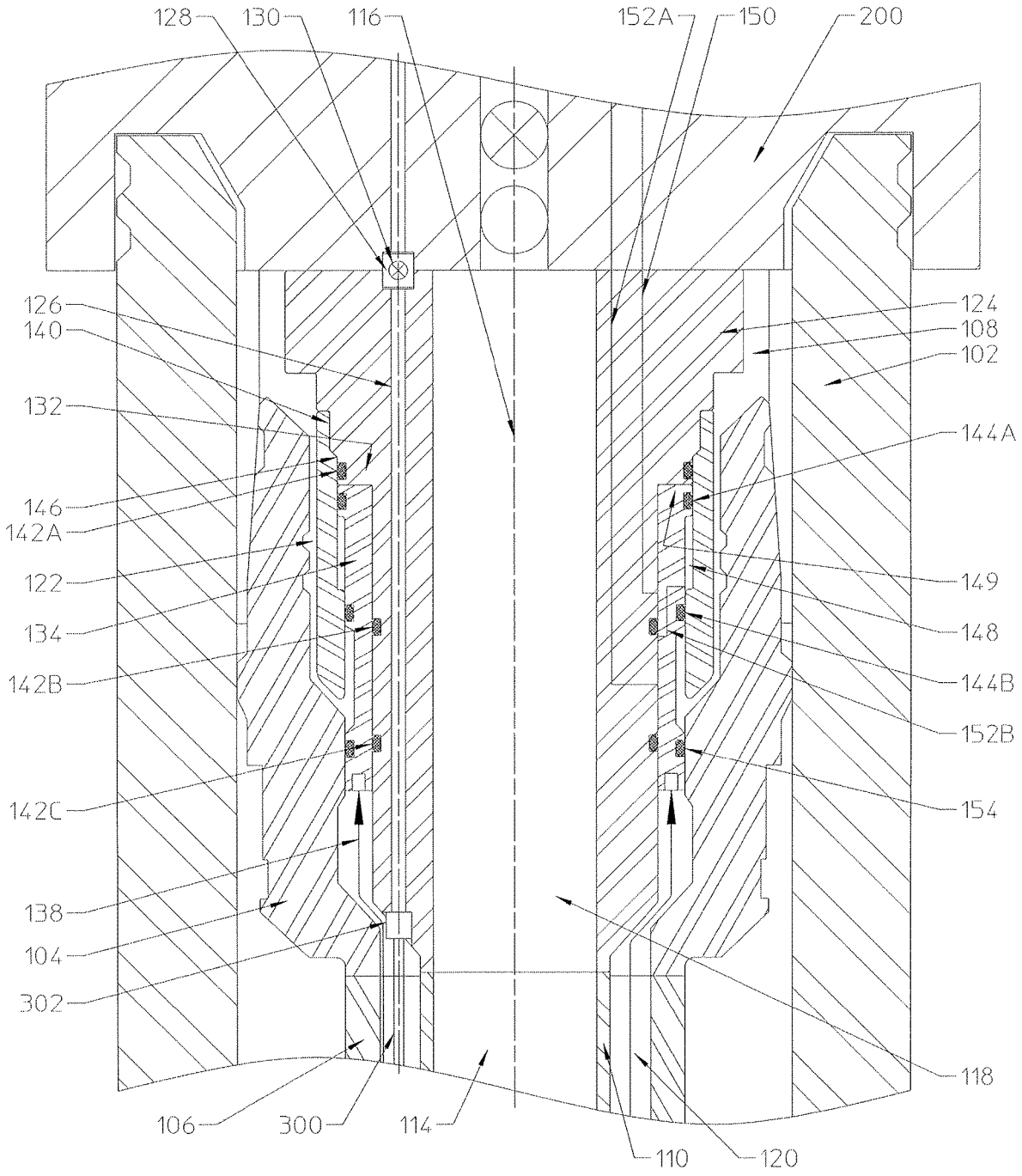
FIG. 2 is a partial cutaway view of the completion assembly of FIG. 1 with the shiftable annulus seal in a closed configuration, in accordance with an embodiment of the present disclosure.

The tubing hanger 108 further includes a shiftable annulus seal assembly 132 in the form of aa sealing sleeve 134 located in an annular space between the tubing hanger 108 and the surrounding casing hanger 104. The shiftable annulus assembly 132 may shift the sealing sleeve 134 up or down within this annulus to selectively allow or block fluid communication through the first annulus flow path 122. As shown in FIG. 1, the sealing sleeve 134 is in a relatively downward axial position within the tubing hanger 108, allowing a flow of fluid (arrows 136) from the annulus 120 upward through the tubing hanger 108. This is the open position for the larger annulus flow path 122 through the tubing hanger 108. In FIG. 2, the sealing sleeve 134 is moved to a relatively upward axial position within the tubing hanger 108, thereby sealing, the tubing hanger 108 against the casing hanger 104 and preventing annulus fluid (arrows 138) from flowing through the tubing hanger 108. This is the closed position for the larger annulus flow path 122.

In the illustrated embodiment, the shiftable annulus seal assembly 132 includes the sealing sleeve 134, a housing 140, multiple seals 142 and 144, and a primary annulus seal 154. The housing 140 is coupled to the main body 124 of the tubing hanger 108 in the illustrated embodiment. The housing 140 may be directly attached to the main body 124 via threads or some other attachment mechanism. In other embodiments, the housing 140 may be integral with the main body 124 such that housing 140 and main body 124 are machined from the same continuous piece of material.

The housing 140 is an axially oriented cylindrical piece of material extending downward from a radially external edge 146 of the main body 124. The main body 124 may have a relatively smaller outer diameter at a position below this radially external edge 146, such that the housing 140 and the main body 124 define a chamber 148 therebetween. An upper end of the sealing sleeve 134 is located within the chamber 148 and functions as a piston 149 to actuate the sealing sleeve 134 between the open position of FIG. 1 and the sealing position of FIG. 2. Hydraulic fluid communicated to the shiftable annulus seal assembly 132 via ports 150 and 152 urges the piston portion 149 of the sealing sleeve 134 in an axially upward or downward position to change the configuration of the seal assembly 132.

The chamber 148 is fluidly sealed via a first seal (e.g., o-ring) 142A on the main body 124, a second seal 142B on the main body 124, and a first seal 144A on the sealing sleeve 134. The seal 142A is disposed along and seals between the radially external edge 146 of the main body 124 and the housing 140. In embodiments where the housing 140 is integral with the main body 124, this seal 142A does not exist. The seal 142B is disposed along the main body 124 to seal an interface between the main body 124 and the sealing sleeve 134. The seal 144A is disposed along the sealing sleeve 134 to seal an interface between the sealing sleeve 134 and the housing 140 at position within the chamber 148.

Another seal 144B is disposed along the sealing sleeve 134 to seal an interface between the sealing sleeve 134 and the housing 140 at an axial position below the chamber 148. Yet another seal 142C is disposed along the main body 124 to seal an interlace between the main body 124 and the sealing, sleeve 134 at an axial position below the seal 142B. The annulus seal 154 is disposed on a lower end of the sealing sleeve 134 to selectively seal an interface between the sealing sleeve 134 and, the surrounding casing hanger 104 (or alternatively, wellhead or tubing head), thereby sealing the annulus flow path 122 as shown in FIG. 2.

A first port 150 may extend through the main body 124 of the tubing hanger 108 to an upper side of the chamber 148. That is, the first port 150 extends to a radially external surface of the main body 124 axially located above the seal 142B. In embodiments where the housing 140 is a separate component attached to the main body 124, the first port 150 extends to a radially external surface of the main body axially located between the seals 142A and 142B. Any hydraulic fluid communicated, to the chamber 148 via this port 150 will apply a downward force on the piston portion 149 of the sealing sleeve 134 to force the sealing sleeve 134 in an axially downward direction.

A second port 152A may extend through the main body 124 of the tubing hanger 108 to a location in the annulus between the main body 124 and the sealing sleeve 134. Specifically, the second port 152A extends to a radially external surface of the main body 124 axially located between the seals 142B and 142C. A corresponding port 152B extends through the sealing sleeve 134 to fluidly connect the port 152A to a lower side of the chamber 148. Specifically, the port 152B extends from a first location on a radially inner surface of the sealing sleeve 134 to a second location on a radially outer surface of the sealing sleeve 134. The first (radially internal) position of the port 152B is located axially between the seals 142B and 142C throughout the entire range of motion of the sealing sleeve 134 with respect to the main body 124. The second (radially external) position of the port 152B is located axially between the seals 144A and 144B on the sealing, sleeve 134. Any hydraulic fluid communicated to the chamber 148 via the ports 152A and 152B will apply an upward force on the piston portion 149 of the sealing sleeve 134 to force the sealing sleeve 134 in an axially upward direction.

Hydraulic fluid may be communicated through these ports 150 and 152 to selectively actuate the sealing sleeve 134 upward (FIG. 2) to seal the annulus flow path 122 via the annulus seal 154, or to selectively actuate the sealing sleeve 134 downward (FIG. 1) to disengage the seal 154 and open the annulus flow path 122. This hydraulic fluid may be communicated by a hydraulic control system that is located, for example: within the running tool; in a subsea tree that later replaces the running tool; at the surface, with hydraulic signals being communicated through an umbilical; in a remote operated vehicle (ROV) engaged with the running tool/subsea tree; or some combination thereof. However, this is not an exhaustive list, and those skilled in the art would recognize various ways to implement providing hydraulic control fluid to the ports 150 and 152 within the tubing hanger 108.

Having described the tubing hanger 108 and its shiftable annulus seal assembly 132, a more detailed description of the functions of these components will now be provided. During completion operations, the tubing hanger 108 is lowered into the wellhead housing 102. The shiftable annulus seal assembly 132 may be in the open position of FIG. 1 during the initial lowering of the tubing hanger 108 into the wellhead 102. At this point, it may be desirable to circulate fluid(s) through the production bore 114 and annulus 120 to condition the well before sealing the larger annulus flow path 122. Fluids are pumped down the production bore 114, out into the annulus 120, and up through the annulus flow path 122. The fluids are pumped back to the surface (e.g., via a corresponding annulus flow path through the running tool/other equipment) and possibly recycled for later use.

After conditioning the well, it may be desirable to set a production packer in the annulus 120. This may involve further circulation of fluid followed by isolating the bottom of the production tubing 110, thereby cutting off the circulation path. Operationally, once the completion system 100 is landed and the production packer is set, the annulus seal assembly 132 is then shifted to isolate the annulus 120. As described above, this is accomplished by communicating hydraulic control fluid through the ports 152A and 152B to force the sealing sleeve 134 upward, thereby sealing the larger annulus flow path 122 via the seal 154 (FIG. 2).

After sealing the first annulus flow path 122, the seal 154 can then be tested from below using the second annulus flow path 126. Specifically, the tubing hanger running tool 112 and umbilical apply pressure downward through the annulus flow path 126. This increased pressure enters the annulus 120 through the annulus flow path 126 and presses upward against the seal 154. The pressure in the annulus 120 may be monitored through the annulus flow path 126, and if there is a noticeable decrease in pressure through the annulus 120 over time, this indicates a leak in the seal 154.

The ability to test a tubing hanger seal from below is not typically available using traditional tubing hanger systems, due to these systems only having a single flow path to the annulus. These systems can only test the annulus seal from above, as there is no other flow path to the annulus. The disclosed tubing hanger 108 provides a more accurate and informative method for testing the seal 154 in the annulus 120 as compared to existing tubing hangers since it allows for testing the seal 154 from below and above, not just above.

After shifting the seal closed (and possibly testing the seal from below), the seal 154 may remain set for the duration of normal production operations. The running tool 112 may be removed and retrieved, and a subsea tree 200 may be positioned on the tubing hanger 108, as shown in FIG. 2. The subsea tree 200 may provide various flow paths and valves for communicating production fluid to a topsides facility. The tubing hanger 108, subsea tree 200, or some other component fluidly coupled to the annulus flow path 126 may be equipped with a pressure sensor for monitoring pressure build up in the annulus 120 and/or a valve for selectively bleeding excess pressure from the annulus 120.

In some embodiments, it may be desirable to perform gas lift operations or other operations within the well that require circulation of a high volume of fluid or gas downhole during a normal production mode. In such instances, the shiftable annulus seal 132 of the tubing hanger 108 may be shifted from the closed position of FIG. 2 to the open position of FIG. 1 (by applying hydraulic fluid through port 150) after the subsea tree 200 is installed and tested. The shiftable annulus; seal 132 will be shifted back into the sealing position of FIG. 2 if there is a need to remove the subsea tree 200 later in the life of the well (e.g., for workover operations).

In normal production operations, the shiftable annulus seal 132 isolates the annulus flow path 122, and the separate annulus flow path 126/hydraulic coupling 128 routes the annulus fluid for pressure monitoring/venting operations. This simplifies material selection for certain components of the production system coupled to this flow path 126, since it eliminates the need for hydraulic and electrical penetrators to be suitable for annulus well fluids and pressures. Since these components are not exposed to the abrasive well fluids during the circulation phase, they can be made with less costly materials/designs.

FIGS. 1 and 2 show an embodiment of the tubing hanger 108 that features a small piece of tubing 300 running downhole through the annulus 120 below the tubing hanger 108. As shown, the tubing 300 is connected to the flow path 126 through the tubing hanger 108 via a coupling 302, so that the tubing 300 fluidly connects the flow path 126 to the annulus 120. This piece of tubing 300 may have a length of approximately 500-1000 feet, thereby opening the flow path 126 to a lower position within the annulus 120. A distal end of the tubing 300 extending downhole may include a strainer or filter to prevent debris from entering the tubing 300 and the flow path 126 and potentially blocking the valve 130. The extended tubing 300 may be particularly useful for providing a nitrogen gas spring to the annulus 120 where such a spring is needed (e.g., high pressure high temperature wells). The annulus flow path 126 used in conjunction with the length of tubing 300 allows the annulus bore to be filled with nitrogen that acts as a gas spring, reducing pressure build up in the annulus with higher temperature wells.

Figure 3:
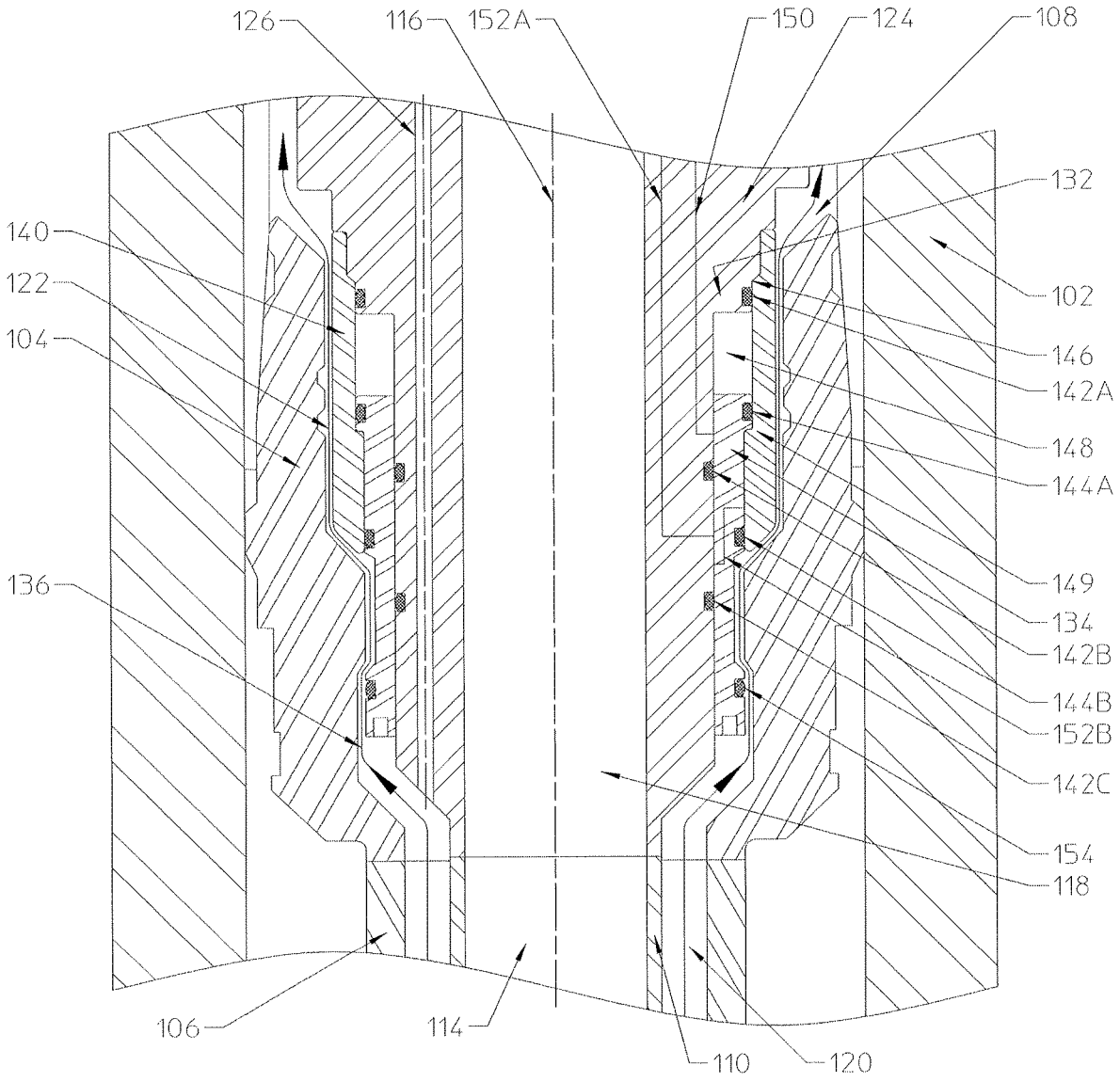
FIG. 3 is a partial cutaway view of another completion assembly including a tubing hanger with a shiftable annulus seal, in accordance with an embodiment of the present disclosure.

It should be noted that this tubing 300 is optional, and other embodiments of the disclosed tubing hanger 108 do not include this extended piece of tubing. FIG. 3 shows an embodiment of the tubing hanger 108 without such a piece of tubing. The flow path 126 is instead open directly below the tubing hanger 108 to receive pressure from the annulus 120. A strainer or filter may be attached at the lower end of the flow path 126 through the tubing hanger 108 to prevent debris from entering the flow path 126 and potentially blocking the valve 130.

Although the present disclosure and its advantages have been described in detail, it should be understood that various changes, substitutions and alterations can be made herein without departing from the spirit and scope of the disclosure as defined by the following claims.

What is claimed is:

1. A system, comprising:

a tubing hanger comprising a shiftable annulus seal assembly configured to be axially shifted between a first position where the shiftable annulus seal assembly blocks a first annulus flow path around a main body of the tubing hanger and a second position where the first annulus flow path is open, wherein the shiftable annulus seal assembly is disposed around the main body;

wherein the tubing hanger further comprises a second annulus flow path extending through the main body of the tubing hanger.

2. The system of claim 1, wherein the first annulus flow path comprises an annular space between a radially outer edge of the tubing hanger and a radially inner edge of a casing hanger, wellhead, or tubing head in which the tubing hanger is located, wherein the annular space extends from a position below the tubing hanger to a position above the tubing hanger while the first annulus flow path is open.

3. The system of claim 1, wherein the shiftable annulus seal assembly comprises:

a sealing sleeve, wherein the sealing sleeve is located in an annular space between the tubing hanger and a surrounding casing hanger, wellhead, or tubing head; and a primary annulus seal, wherein the primary annulus seal is disposed on a lower end of the sealing sleeve to selectively seal an interface between the sealing sleeve and the surrounding casing hanger, wellhead, or tubing head.

4. The system of claim 3, wherein the shiftable annulus seal assembly further comprises a housing, wherein the housing is an axially oriented cylindrical piece of material extending downward from a radially external edge of the main body of the tubing hanger;

wherein a chamber is defined between the housing and the main body of the tubing hanger, and wherein an upper end of the sealing sleeve is disposed within the chamber and functions as a piston.

5. The system of claim 4, wherein the housing is integral with the main body.

6. The system of claim 5, further comprising:

a first port that extends through the main body of the tubing hanger to a radially external surface of the main body axially located above the second seal disposed on the main body; and a second port that extends through the main body of the tubing hanger to a radially external surface of the main body axially located between the second seal disposed on the main body and the third seal disposed on the main body.

7. The system of claim 6, further comprising a sealing sleeve port, wherein the sealing sleeve port extends through the sealing sleeve to fluidly connect the second port to a lower side of the chamber.

8. The system of claim 7, wherein the sealing sleeve port extends from a first location on a radially inner surface of the sealing sleeve to a second location on a radially outer surface of the sealing sleeve.

9. The system of claim 8, wherein the first location of the sealing sleeve port is disposed axially between the second seal disposed on the main body and the third seal disposed on the main body throughout an entire range of motion of the sealing sleeve with respect to the main body, wherein the second location of the sealing sleeve port is disposed axially between the first seal disposed on the sealing sleeve and the second seal disposed on the sealing sleeve.

10. The system of claim 4, wherein the housing is a separate piece of material from the main body, wherein the shiftable annulus seal assembly further comprises a first seal disposed on the main body that seals between a radially external edge of the main body and the housing.

11. The system of claim 4, wherein the shiftable annulus seal assembly further comprises:

a second seal disposed on the main body that seals an interface between the main body and the sealing sleeve;

a first seal disposed on the sealing sleeve that seals an interface between the sealing sleeve and the housing at position within the chamber; and a second seal disposed on the sealing sleeve that seals an interface between the sealing sleeve and the housing at an axial position below the chamber; and a third seal disposed on the main body that seals an interface between the main body and the sealing sleeve at an axial position below the second seal disposed on the main body.

12. The system of claim 4, further comprising hydraulic control fluid ports extending at least through the main body, wherein the hydraulic control fluid ports are configured to communicate hydraulic fluid to opposite sides of the piston within the chamber.

13. The system of claim 1, wherein the second annulus flow path extends from an annulus between an outer diameter of a tubing string coupled to the tubing hanger and an inner diameter of a surrounding casing string at a lower end to a hydraulic coupling at an upper end.

14. The system of claim 13, wherein the hydraulic coupling is coupled to a valve.

15. The system of claim 13, further comprising a tubing connected to the second annulus flow path via a coupling, wherein the tubing extends downward through the annulus.

16. The system of claim 1, further comprising:

a wellhead housing; and a casing hanger supporting a casing string, wherein the casing hanger is landed in and sealed against the wellhead housing, wherein the tubing hanger is seated against the casing hanger.

17. The system of claim 16, wherein a running tool is coupled to the tubing hanger, wherein the running tool includes a flow path formed therethrough that intersects or interfaces with the annulus flow path around the main body of the tubing hanger.

18. The system of claim 16, wherein a subsea tree is coupled to the tubing hanger and is fluidly coupled to the second annulus flow path.

19. A method, comprising:

landing a tubing hanger in a casing hanger, wellhead, or tubing head, wherein the tubing hanger comprises:

a main body;

a shiftable annulus seal assembly disposed around the main body; and a secondary annulus flow path extending through the main body of the tubing hanger;

maintaining the shiftable annulus seal assembly in a first position to keep the a first annulus flow path open around the main body of the tubing hanger; and axially shifting the shiftable annulus seal assembly from the first position to a second position in which the shiftable annulus seal assembly blocks the first annulus flow path.

20. The method of claim 19, further comprising:

circulating fluid through the first annulus flow path while the shiftable annulus seal is in the first position; and communicating fluid through the second annulus flow path while the shiftable annulus seal is in the second position.

* * * * *